US011987913B2

(12) United States Patent
Cong et al.

(10) Patent No.: US 11,987,913 B2
(45) Date of Patent: May 21, 2024

(54) YARN CARRIER DEVICE WITH YARN TENSION CONTROL FUNCTION FOR FLAT KNITTING MACHINE, AND YARN TENSION CONTROL METHOD

(71) Applicant: JIANGNAN UNIVERSITY, Wuxi (CN)

(72) Inventors: Honglian Cong, Wuxi (CN); Gaoming Jiang, Wuxi (CN); Zhijia Dong, Wuxi (CN); Guangjun Wu, Wuxi (CN); Yuxian Li, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 0 days.

(21) Appl. No.: 18/061,041

(22) Filed: Dec. 2, 2022

(65) Prior Publication Data

US 2023/0100197 A1 Mar. 30, 2023

Related U.S. Application Data

(63) Continuation of application No. PCT/CN2021/120634, filed on Sep. 26, 2021.

(30) Foreign Application Priority Data

Jul. 13, 2021 (CN) ..... 202110790210.5

(51) Int. Cl.
*D04B 15/44* (2006.01)
*B65H 59/00* (2006.01)
(Continued)

(52) U.S. Cl.
CPC ..... *D04B 15/44* (2013.01); *B65H 59/005* (2013.01); *D04B 15/48* (2013.01); *D04B 27/12* (2013.01); *B65H 2701/31* (2013.01)

(58) Field of Classification Search
CPC ..... D04B 15/44; D04B 15/46; D04B 15/48; D04B 27/12; B65H 59/005
(Continued)

(56) References Cited

U.S. PATENT DOCUMENTS

2018/0023228 A1* 1/2018 Jiang ..... D04B 27/12 139/97

FOREIGN PATENT DOCUMENTS

CN 202766752 U 3/2013
CN 203866498 U * 10/2014 ..... D04B 35/18
(Continued)

OTHER PUBLICATIONS

First Office Action issued in Chinese Application No. 202110790210.5; dated Mar. 28, 2022; 11 pgs.
(Continued)

*Primary Examiner* — Aiying Zhao
(74) *Attorney, Agent, or Firm* — HAUPTMAN HAM, LLP

(57) ABSTRACT

This application relates to a yarn carrier device with a yarn tension control function for a flat knitting machine, and a yarn tension control method. At the moment a carriage is connected to a yarn carrier device, a fixing frame carrying a bobbin ascends or descends on sliding rails installed on the yarn carrier device. The ascending or descending speed, time and distance of the fixing frame can be calculated directly according to a yarn carrier stop, the quantity of an unknitted portion of the yarn and the speed of the carriage. When the carriage contacts a yarn carrier, the fixing frame is controlled to ascend along the sliding rails. When the carriage drives the yarn carrier to enter a knitting area, the fixing frame is controlled to descend.

4 Claims, 3 Drawing Sheets

(51) Int. Cl.
*D04B 15/48* (2006.01)
*D04B 27/12* (2006.01)

(58) Field of Classification Search
USPC ..... 66/146, 160, 211, 213
See application file for complete search history.

(56) References Cited

FOREIGN PATENT DOCUMENTS

| | | | | | |
|---|---|---|---|---|---|
| CN | 203866498 | U | | 10/2014 | |
| CN | 104389102 | A | | 3/2015 | |
| CN | 108823777 | A | * | 11/2018 | ..... D04B 15/56 |
| CN | 108823777 | A | | 11/2018 | |
| EP | 3546630 | A1 | * | 10/2019 | ..... D04B 15/00 |
| EP | 3546631 | A1 | * | 10/2019 | ..... D04B 15/44 |
| EP | 3546632 | A1 | * | 10/2019 | ..... D04B 15/44 |
| EP | 3799258 | A1 | * | 3/2021 | ..... B60L 13/03 |
| JP | 10102361 | A | * | 4/1998 | ..... D04B 15/48 |

OTHER PUBLICATIONS

Search Report issued in Chinese Application No. 202110790210.5; dated Mar. 21, 2022; 2 pgs.
Notification to Grant a Patent issued in Chinese Application No. 202110790210.5; dated Sep. 21, 2022; 3 pgs.

* cited by examiner

YARN CARRIER DEVICE WITH YARN TENSION CONTROL FUNCTION FOR FLAT KNITTING MACHINE, AND YARN TENSION CONTROL METHOD

CROSS-REFERENCE TO RELATED APPLICATIONS

The present application is a Continuation of International Application Number PCT/CN2021/120634, filed Sep. 26, 2021, and claims priority to Chinese Application 202110790210.5, filed Jul. 13, 2021, the disclosure of which is hereby incorporated by reference herein in their entireties.

BACKGROUND OF THE INVENTION

1. Technical Field

The invention belongs to the technical field of textile machines, and particularly relates to a yarn guide with a yarn tension control function for a flat knitting machine, and a yarn tension control method.

2. Description of Related Art

The yarn guide is used for guiding yarn to enter computerized flat knitting machines to be knitted, and in this process, the yarn first passes through a bobbin on the yarn guide, and then enters the yarn guide opening to be knitted. After a course of a yarn is knitted, the yarn guide leaves the knitting area and is then controlled by the carriage to return to knit the next line of yarn. Existing flat knitting machines allow yarn to enter from one side, and an unknitted portion of the yarn in the yarn guide cannot be recycled in time when the yarn guide returns to knit the next line of yarn, so the tension of the yarn will become larger, resulting in non-uniform sizes of stitches in upper and lower lines of the edge of a knitted piece. Different tensions will lead to different sizes of loops, thus forming a nonuniformity of 1-2 inches in structure, namely nonuniform stitches, on the edge of the knitted piece. Tension devices are disposed on the side face of existing computerized flat knitting machines to recycle an unknitted portion of the yarn. However, because these tension devices are away from the yarn guide and the turning speed of the carriage is too high, the tension of yarn cannot be controlled in time due to untimely responses of the tension devices.

BRIEF SUMMARY OF THE INVENTION

The technical issue to be settled by the invention is to provide a yarn guide with a yarn tension control function for a flat knitting machine, and a yarn tension control method, which solve the problem that the tension of yarn cannot be controlled in time when the carriage turns, and enable a yarn guide to control the tension of yarn timely, thus making the edge of a knitted piece have a uniform structure and a flew flaws.

One technical solution adopted by the invention to settle the above technical issues is as follows: the yarn carrier device with a yarn tension control function for a flat knitting machine comprises a carriage connector, wherein the carriage connector is connected to a carriage, such that the carriage is able to drive the yarn carrier device for a flat knitting machine to move leftwards and rightwards; the carriage connector is installed on a Uz seat, a yarn guide sliding rod is fixed on the Uz seat, and a lower portion of the yarn guide sliding rod is connected to a yarn guide; a fixing frame is slidably disposed on the yarn guide sliding rod, a bobbin and a signal receiver are installed on the fixing frame, and the signal receiver is used for receiving a control signal for controlling the fixing frame to ascend or descend; a contact sensor is disposed on the carriage connector, a signal output end of the contact sensor is connected to a carriage control system, and the contact sensor is used for outputting a contact signal of a carriage and a yarn carrier device; and the carriage control system comprises a signal emitter, which transmits an ascending or descending instruction of the fixing frame to the signal receiver, and after the signal receiver receives the ascending or descending instruction, the fixing frame ascends or descends along vertical sliding grooves.

Further, the Uz seat and a clip are fixed together.

Further, the fixing frame is in sliding fit with sliding blocks through the vertical sliding grooves formed in the yarn guide sliding rod.

The invention further provides a yarn tension control method of a yarn carrier device for a flat knitting machine, comprising:

(1) Connecting a carriage and a carriage connector, and outputting, by a contact sensor, a contact signal of the carriage and a yarn carrier device to a carriage control system;

(2) After the carriage drives the yarn carrier device to knit a course of a yarn, driving, by the carriage, the yarn carrier device to move from a knitting area to a yarn guide stop, separating the carriage from the yarn carrier device, and at this moment, stopping the yarn carrier device from moving;

(3) When the carriage turns, connecting the carriage to the yarn carrier device again, such that the yarn carrier device is driven by the carriage to enter the knitting area again; feeding, by the contact sensor, a contact signal of the carriage and the yarn carrier device back to the carriage control system, emitting, by a signal emitter, an ascending instruction of a fixing frame, and after a signal receiver on the fixing frame receives the ascending instruction emitted by the signal emitter, driving, by the fixing frame, a bobbin to ascend along vertical sliding grooves to tension an unknitted portion of the yarn; and (4) After the carriage turns to enter the knitting area again, driving the fixing frame to descend along the vertical sliding grooves to enable an unknitted portion of the yarn to be uniformly distributed on knitting needles participating in knitting.

Further, an ascending height of the fixing frame does not exceed a space extending from a first terminal end of the yarn guide sliding rod to a second terminal end of the yarn guide sliding rod in a longitudinal direction of the yarn guide sliding rod. Further, the ascending height (h) of the fixing frame is $h=\sqrt{x_1^2-x_2^2}-H_0$, where $x_1$ is the sum of a linear distance from the bobbin to a yarn guide opening before the carriage turns after knitting of a course of a yarn and a linear distance from the bobbin to the yarn guide opening after the carriage returns and the bobbin ascends; $x_2$ is a horizontal distance from the bobbin to the yarn guide opening, and $H_0$ is an original height of the bobbin; an ascending speed ($V_1$) of the bobbin is $V_1=h/T$, $T=X_4/V_0$, where $X_4$ is a horizontal distance from the yarn guide stop to an edge of a knitted piece, and $V_0$ is a weft knitting speed of a flat knitting machine comprising the claimed yarn carrier device.

Further, a descending speed of the fixing frame=h/a total number of knitting needles participating in knitting; and after the course of the yarn is knitted, the fixing frame returns to an initial position exactly.

The invention has the following specific advantages:

According to the invention, when the fixing frame ascends or descends, the bobbin ascends or descends at the same time to draw and recycle an unknitted portion of the yarn generated when the carriage turns, such that the edge structure of a woven piece is uniform, and loops have the same size. When the carriage turns, the yarn guide can control the tension of yarn timely, such that the woven piece has a uniform edge structure and a few flaws.

Reference signs: 1, carriage connector; 2, Uz seat; 21, seat; 22, two horizontally projected arms; 3, elastic piece; 4, yarn guide sliding rod; 5, fixing frame; 6, bobbin; 7, signal receiver; 8, vertical sliding groove; 9, yarn guide; 10, yarn guide opening;

DETAILED DESCRIPTION OF THE INVENTION

In order to make the above purposes, features and advantages of the invention clearer and easily understood, the specific embodiments of the invention will be further described below in conjunction with specific drawings.

Many specific details are expounded in the following description to provide a comprehensive understanding of the invention, but the invention can also be implemented in other ways different from those described here. Those skilled in the art can make similar modifications without departing from the concept of the invention, so the invention should not be limited by the specific embodiments disclosed below.

Embodiment 1

Figure 1:
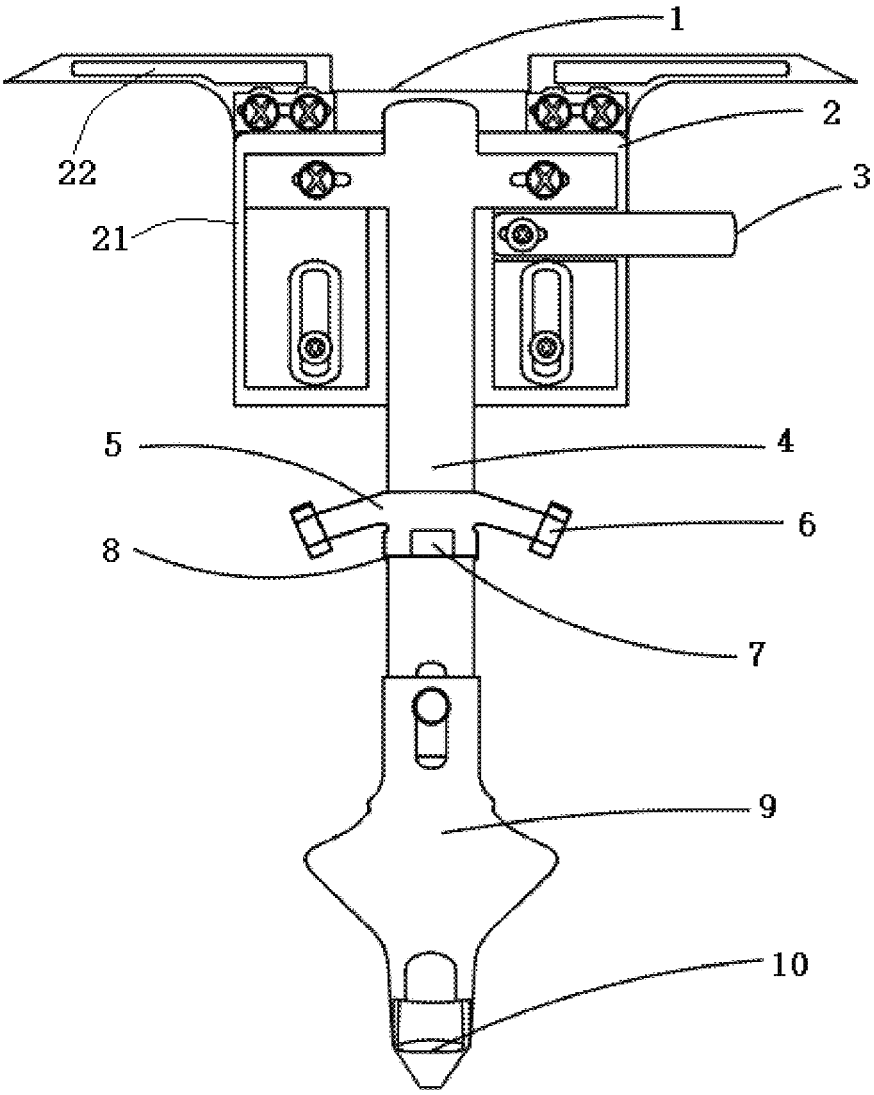
FIG. 1 is a front structural view of a yarn carrier device for a flat knitting machine according to the invention.
Figure 2:
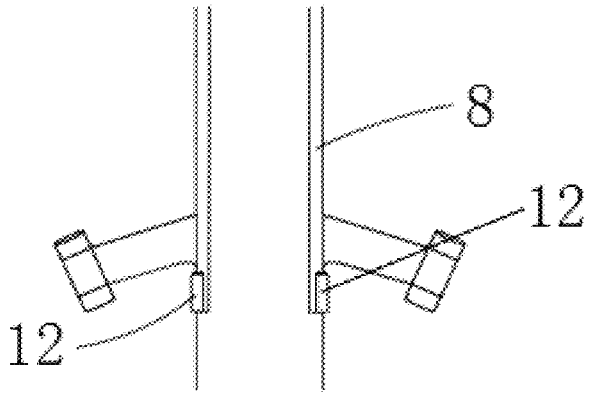
FIG. 2 is a connection diagram of a fixing frame and a yarn guide sliding rod.
Figure 3:
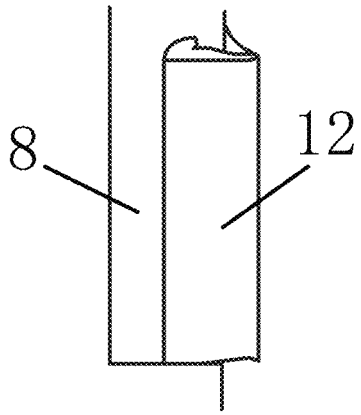
FIG. 3 is a structural diagram of a sliding block.
Figure 4:
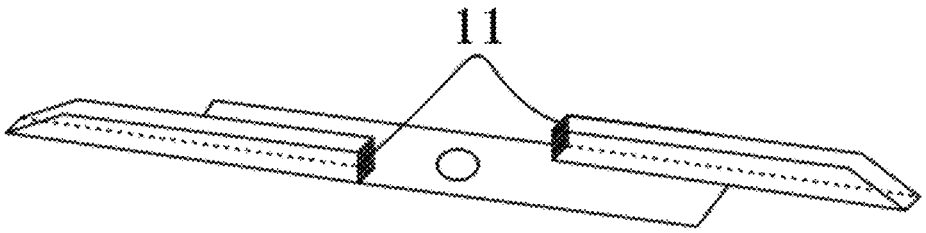
FIG. 4 is a structural diagram of a carriage connector.

This embodiment provides a yarn carrier device with a yarn tension control function for a flat knitting machine. With the yarn guide structure of Longxing E14 double-bed computerized flat knitting machine as an example, the yarn carrier device for a flat knitting machine, as shown in FIG. 1, comprises a carriage connector 1, wherein the carriage connector 1 is connected to a carriage, such that the carriage is able to drive the yarn carriage for a flat knitting machine to move leftwards and rightwards; the carriage connector 1 is installed on a Uz seat 2, and the Uz seat 2 and a clip 3 are fixed together through a screw; Uz seat 2 includes seat 21 and two horizontally projected arms 22; a yarn guide sliding rod 4 is fixed on the Uz seat 2 through a left screw and a right screw, and a lower portion of the yarn guide sliding rod 4 is connected to a yarn guide 9 through a screw; a fixing frame 5 is slidably arranged on the yarn guide sliding rod 4, and as shown in FIG. 2, the fixing frame 5 is in sliding fit with sliding blocks 12 through vertical sliding grooves 8 formed in the yarn guide sliding rod 4; a signal receiver 7 is installed on the fixing frame 5 and is used for receiving a control signal for controlling the fixing frame 5 to ascend or descend; a bobbin 6 is installed on the fixing frame 5, and yarn entering the flat knitting machine from one side passes through the bobbin 6 first, and is then conveyed to a yarn guide opening 10 of the yarn guide 9 to be knitted, and when the fixing frame 5 ascends or descends in the vertical sliding grooves 8, the bobbin 6 ascends or descends at the same time to control the tension of the yarn; as shown in FIG. 3, a contact sensor 11 is disposed on the carriage connector 1; as shown in FIG. 4, a signal output end of the contact sensor 11 is connected to a carriage control system, and the contact sensor 11 is used for outputting a contact signal of the carriage and a yarn carrier device; and the carriage control system comprises a signal emitter, which transmits an ascending or descending instruction of the fixing frame to the signal receiver, and after the signal receiver receives the ascending or descending instruction, the fixing frame ascends or descends along the vertical sliding grooves.

Embodiment 2

A yarn tension control method of the yarn carrier device for a flat knitting machine comprises the following steps:

(1) The carriage and the carriage connector are connected, and the contact sensor outputs a contact signal of the carriage and the yarn carrier device to the carriage control system;

(2) After driving the yarn carrier device to knit a course of a yarn, the carriage drives the yarn carrier device to move from a knitting area to a yarn guide stop, the carriage is separated from the yarn carrier device, and at this moment, the yarn carrier device stops moving;

(3) When the carriage turns, the carriage is connected again to the yarn carrier device and drives the yarn carrier device to enter the knitting area again; the contact sensor feeds a contact signal of the carriage and the yarn carrier device back to the carriage control system, then the signal emitter emits an ascending instruction of the fixing frame, and after the signal receiver on the fixing frame receives the ascending instruction from the signal emitter, the fixing frame drives the bobbin to ascend along the vertical sliding grooves to tension an unknitted portion of the yarn;

Because the space between yarn guides is limited, the yarn guides may collide with each other during the knitting process if the ascending or descending distance of the fixing frame is too large; so, a maximum ascending or descending space H of the yarn guides needs to be measured, the yarn guide stop and the quantity of an unknitted portion of the yarn should not be too large, and the ascending or descending space of the yarn guides should not exceed the maximum ascending or descending space H;

If the time for the yarn guides to move from the yarn guide stop to the edge of a knitted piece is T, the ascending height h of the lifting frame within the time T should not exceed the maximum ascending or descending space H;

The ascending height of the fixing frame is $h=\sqrt{x_1^2-x_2^2}-H_0$, wherein $x_1$ is the sum of a linear distance from the bobbin to the yarn guide opening before the carriage turns after knitting of a course of a yarn and a linear distance from the bobbin to the yarn guide opening after the carriage returns and the bobbin ascends; $x_2$ is a horizontal distance from the bobbin to the yarn guide opening, and $H_0$ is an original height of the bobbin; an ascending speed of the bobbin is $V_1=h/T$, $T=X_4/V_0$, where $X_4$ is a horizontal distance from the yarn guide stop to the edge of the knitted piece, and $V_0$ is the weft knitting speed of a flat knitting machine comprising the claimed yarn carrier device;

(4) In order to keep the sizes of loops uniform and the surface of the knitted piece flat and beautiful, and allow the an unknitted portion of the yarn to be uniformly distributed on knitting needles participating in knitting after the carriage turns to enter the knitting area again, the fixing frame starts to descend along the vertical sliding grooves when the carriage control system turns to enter the knitting area and receives a signal indicating that the knitting needles start to move, wherein the descending speed is set according to the ascending height h of the fixing frame and the total number of the knitting needles participating in knitting, that is, the descending speed=h/the total number of the knitting needles participating in knitting; and after a course of a yarn is knitted, the fixing frame returns to an initial position exactly.

Embodiment 3

Figure 5:
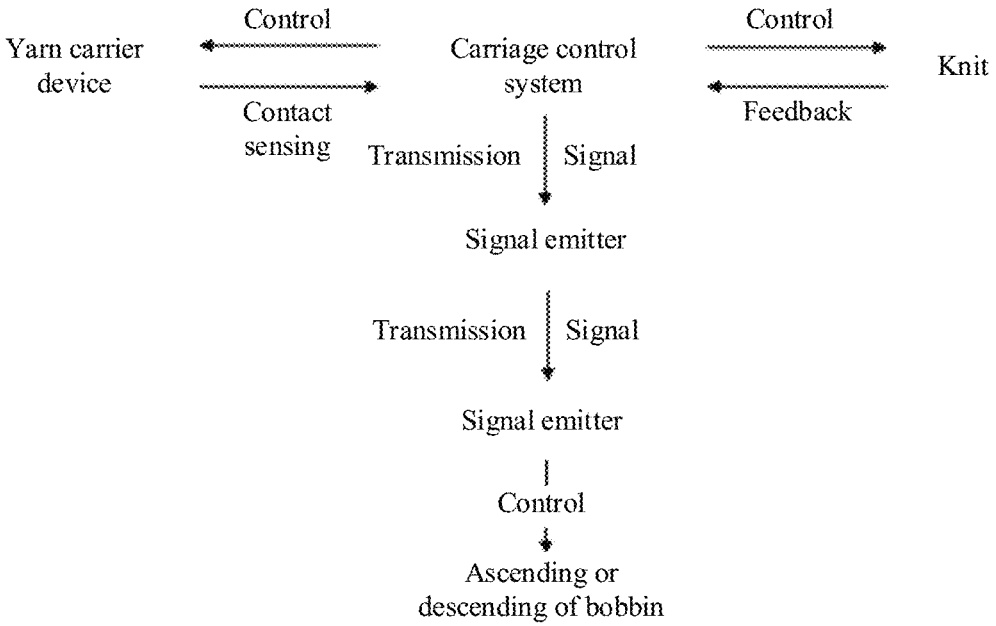
FIG. 5 is a control diagram of a bobbin.
Figure 6:
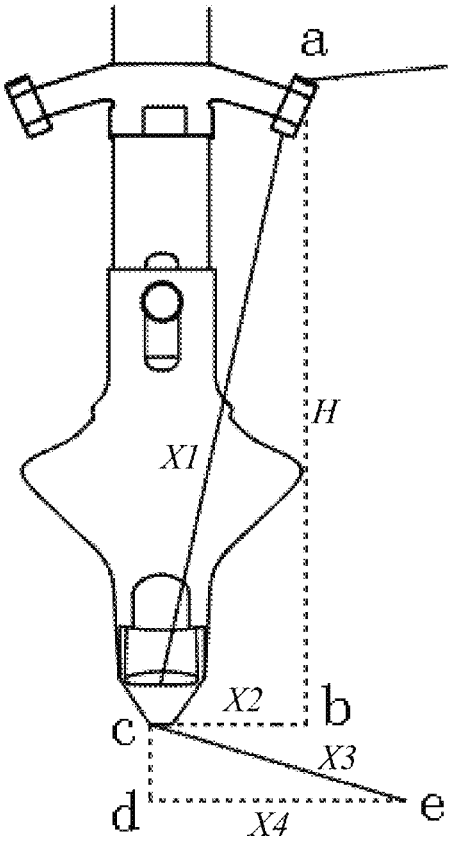
FIG. 6 is a schematic diagram of an ascending or descending algorithm of the bobbin.

A yarn tension control method of the yarn carrier device for a flat knitting machine in this embodiment comprises the following steps:

(1) The flat knitting machine is Longxing double-bed computerized flat knitting machine, of which the specific parameters are as follows: model: E14; maximum speed: 1.4 m/s; knitting width: 52 inches; as shown in FIG. 5, according to the size of components of the yarn guide, the linear distance $X_1$ from the bobbin to the yarn guide opening is 8 cm, the horizontal distance $X_2$ from the bobbin to the yarn guide opening is 2 cm, and the original height $H_0$ of the bobbin is 8 cm;

(2) After a course of a yarn is knitted, the yarn guide reaches the yarn guide stop c, wherein the yarn guide stop can be manually set; assume the horizontal distance $X_4$ from the yarn guide stop c to the edge e of the knitted piece on the same guide rail is 2 cm and the quantity $X_3$ of an unknitted portion of the yarn is 2.1 cm, after the carriage turns to enter the knitting area again, the quantity $X_3$ of an unknitted portion of the yarn will increase to $X_1$, which is 10.1 cm, with the ascending of the bobbin;

Assume the machine runs at the speed $V_0$=10 cm/s, the time $T=X_4/V_0$ for the yarn guide to move from the yarn guide stop c to the edge e of the knitted piece is 0.2 s, the ascending height $h=\sqrt{x_1^2-x_2^2}-H_0$ of the bobbin is h=1.9 cm, and the ascending speed of the bobbin is $V_1=h/T$=9.5 cm/s, and according to the formula, when the pattern of the knitted piece is designed, the ascending speed $V_1$ and the running time of the bobbin T can be output directly according to the position of the yarn guide stop, the weft knitting speed of a flat knitting machine comprising the claimed yarn carrier device and the height of the yarn guide;

(3) In order to keep the sizes of loops uniform and the surface of the knitted piece flat and beautiful, and allow the an unknitted portion of the yarn to be uniformly distributed on knitting needles participating in knitting after the carriage turns to enter the knitting area again, the fixing frame starts to descend along the vertical sliding grooves, wherein the descending speed is set according to the ascending height of the fixing frame and the total number of the knitting needles participating in knitting, that is, the descending speed=h/the total number of the knitting needles participating in knitting; when the ascending height of the fixing frame is 1.9 cm, assume the total number of the knitting needles participating in knitting is 50, the descending speed of the fixing frame is 0.038 cm/s; and after a course of a yarn is knitted, the fixing frame returns to an initial position exactly.

The yarn carrier device with a yarn tension control function for a flat knitting machine provided by the application is introduced in detail above. The principle and implementation of the application are expounded with several specific embodiments in this specification, merely for the purpose of assisting in understanding the method of the application and the core idea thereof. Moreover, those ordinarily skilled in the art can make modifications to these specific embodiments and application range of the application according to the idea of the application. So, this specification should not be construed as limitations of the invention.

What is claimed is:

1. A yarn tension control method of a yarn carrier device for a flat knitting machine, comprising:

1) connecting a carriage and a carriage connector, and outputting, by a contact sensor, a contact signal of the carriage and the yarn carrier device to a carriage control system;

2) after the carriage drives the yarn carrier device to knit a course of a yarn, driving, by the carriage, the yarn carrier device to move from a knitting area to a yarn guide stop, separating the carriage from the yarn carrier device, and at this moment, stopping the yarn carrier device from moving;

3) when the carriage turns, connecting the carriage to the yarn carrier device again, such that the yarn carrier device is driven by the carriage to enter the knitting area again;

feeding, by the contact sensor, a contact signal of the carriage and the yarn carrier device back to the carriage control system, emitting, by a signal emitter, an ascending instruction of a fixing frame, and after a signal receiver on the fixing frame receives the ascending instruction emitted by the signal emitter, driving, by the fixing frame, a bobbin to ascend along vertical sliding grooves to tension an unknitted portion of the yarn; and 4) after the carriage turns to enter the knitting area again, driving the fixing frame to descend along the vertical sliding grooves to enable the unknitted portion of the yarn to be uniformly distributed on knitting needles participating in knitting;

wherein, the yarn carrier device for a flat knitting machine comprises the carriage connector, and the carriage connector is connected to the carriage, such that the carriage is able to drive the yarn carrier device for a flat knitting machine to move leftwards and rightwards;

the carriage connector is installed on a Uz seat, a yarn guide sliding rod is fixed on the Uz seat, and a lower portion of the yarn guide sliding rod is connected to a yarn guide, wherein the Uz seat is a seat with two horizontally projected arms at a top end of the seat when in use;

the fixing frame is slidably disposed on the yarn guide sliding rod, the bobbin and the signal receiver are installed on the fixing frame, and the signal receiver is used for receiving a control signal for controlling the fixing frame to ascend or descend;

the contact sensor is disposed on the carriage connector, a signal output end of the contact sensor is connected to the carriage control system, and the contact sensor is used for outputting the contact signal of the carriage and the yarn carrier device; and the carriage control system comprises the signal emitter, which transmits the ascending or descending instruction of the fixing frame to the signal receiver, and after the signal receiver receives the ascending or descending instruction, the fixing frame ascends or descends along the vertical sliding grooves.

2. The yarn tension control method of the yarn carrier device for a flat knitting machine according to claim 1, wherein an ascending height of the fixing frame does not exceed a space extending from a first terminal end of the yarn guide sliding rod to a second terminal end of the yarn guide sliding rod in a longitudinal direction of the yarn guide sliding rod.

3. The yarn tension control method of the yarn carrier device for a flat knitting machine according to claim 2, wherein the ascending height (h) of the fixing frame is $h=\sqrt{x_1^2-x_2^2}-H_0$, wherein $x_1$ is a sum of a linear distance from the bobbin to a yarn guide opening before the carriage turns after knitting of the course of the yarn and a linear distance from the bobbin to the yarn guide opening after the carriage returns and the bobbin ascends;

$x_2$ is a horizontal distance from the bobbin to the yarn carrier opening, and $H_0$ is an original height of the bobbin;

an ascending speed ($V_1$) of the bobbin is $V_1=h/T$, $T=X_4/V_0$, wherein $X_4$ is a horizontal distance from the yarn guide stop to an edge of a knitted piece, and $V_0$ is a weft knitting speed of the flat knitting machine comprising the yarn carrier device.

4. The yarn tension control method of the yarn carrier device for a flat knitting machine according to claim 3, wherein a descending speed of the fixing frame=h/a total number of knitting needles participating in knitting; and after the course of the yarn is knitted, the fixing frame returns to an initial position exactly.

* * * * *